US011320235B2

(12) United States Patent
Fischer

(10) Patent No.: US 11,320,235 B2
(45) Date of Patent: May 3, 2022

(54) BARREL HELD FIREARM CARRIER

(71) Applicant: David John Fischer, Haymarket, VA (US)

(72) Inventor: David John Fischer, Haymarket, VA (US)

( * ) Notice: Subject to any disclaimer, the term of this patent is extended or adjusted under 35 U.S.C. 154(b) by 0 days.

(21) Appl. No.: 16/143,443

(22) Filed: Sep. 26, 2018

(65) Prior Publication Data

US 2020/0096289 A1 Mar. 26, 2020

(51) Int. Cl.
*F41C 33/00* (2006.01)
*F41C 33/04* (2006.01)

(52) U.S. Cl.
CPC ..... *F41C 33/007* (2013.01); *F41C 33/046* (2013.01)

(58) Field of Classification Search
CPC .. F41C 33/007; F41C 33/046; F41C 33/0246; F41C 33/0245; F41C 33/0236; F41C 33/06; F41C 33/08; Y10S 224/913; A45F 2200/0566; A45F 2200/0591
USPC ..... 224/913, 251, 200, 661
See application file for complete search history.

(56) References Cited

U.S. PATENT DOCUMENTS 2,761,112 A 8/1956 Torcivia
2,958,448 A * 11/1960 Leclerc ..... A45F 5/00 224/661
4,154,015 A 5/1979 Holland
4,759,483 A * 7/1988 Willoughby ..... A45F 5/14 224/232
D325,300 S 4/1992 Miklus, II
5,184,797 A 2/1993 Humer
D378,398 S 3/1997 Osburn
5,772,089 A * 6/1998 Parsons ..... A45F 5/02 224/245
D407,137 S 3/1999 Thompson
6,397,506 B1 * 6/2002 Oglesby, Jr. ..... F41A 19/52 42/59
6,755,331 B2 6/2004 Rassias
7,258,259 B1 8/2007 Owens
D605,851 S 12/2009 Drake
8,297,562 B1 * 10/2012 Yeates ..... A45F 5/02 248/118.3
D752,176 S 3/2016 Johns
(Continued)

FOREIGN PATENT DOCUMENTS

WO WO 2007/045849 A1 4/2007

OTHER PUBLICATIONS

U.S. Patent Application entitled "Firearm Holster Support" U.S. Appl. No. 29/664,639, filed Sep. 26, 2018.
(Continued)

*Primary Examiner* — Scott T McNurlen

(57) ABSTRACT

A firearm carrier that is design and configured to hold a firearm. In one embodiment, the firearm is a pump-action (or slide-action) firearm, such as a scattergun. The firearm can have a rear portion with a pistol grip, and a forward portion with a barrel and a pump-action (or slide-action) receiver. The firearm carrier can be secured to a user's waist and leg, and then the firearm can be removably secured to the firearm carrier. Advantageously, the firearm carrier is configured to receive a portion of the barrel of the firearm and can thus be secured to the firearm carrier. The firearm can also be rapidly removed from the firearm carrier should the user desire to remove the firearm from the firearm carrier.

19 Claims, 22 Drawing Sheets

(56) References Cited

U.S. PATENT DOCUMENTS

| | | | | |
|---|---|---|---|---|
| 9,914,655 | B2 | 3/2018 | Oinuma et al. | |
| 2002/0002791 | A1 | 1/2002 | Thompson | |
| 2002/0195472 | A1* | 12/2002 | Hickman | A45F 5/021 224/247 |
| 2007/0045364 | A1* | 3/2007 | Grundy | A45F 5/02 224/197 |
| 2007/0185457 | A1 | 8/2007 | Euteneuer | |
| 2007/0292647 | A1 | 12/2007 | Princell | |
| 2008/0000938 | A1* | 1/2008 | Haugen | F41C 33/007 224/242 |
| 2008/0073393 | A1* | 3/2008 | Soderquist | F41C 33/0227 224/243 |
| 2009/0000137 | A1 | 1/2009 | Diaz | |
| 2009/0025942 | A1 | 1/2009 | Hall | |
| 2010/0276464 | A1* | 11/2010 | Hirt | F41C 33/0245 224/243 |
| 2010/0314423 | A1 | 12/2010 | Kawamoto et al. | |
| 2011/0185936 | A1* | 8/2011 | Richardson | F42B 7/046 102/438 |
| 2012/0172153 | A1 | 7/2012 | Newman | |
| 2012/0210793 | A1 | 8/2012 | Daton-Lovett | |
| 2014/0014695 | A1* | 1/2014 | Gyorfi | F41C 33/048 224/222 |
| 2016/0033059 | A1 | 2/2016 | Fonte | |
| 2016/0113370 | A1 | 4/2016 | Arel | |
| 2016/0210955 | A1 | 7/2016 | Lagarrigue | |
| 2016/0363488 | A1 | 12/2016 | Sipila | |
| 2017/0043493 | A1* | 2/2017 | Seber | B26B 29/025 |
| 2019/0001783 | A1 | 1/2019 | Garcia | |

OTHER PUBLICATIONS

"Mossberg 500 Just In Case," O.F. Mossberg & Sons, Inc., 2018, downloaded from http://www.mossberg.com/category/series/500-jic.

"Voodoo Tactical Breachers Shotgun Scabbard," www.opticsplanet.com, 2018, downloaded from https://www.opticsplanet.com/voodoo-tactical-breachers-shotgun-scabbard.html.

* cited by examiner

BARREL HELD FIREARM CARRIER

BACKGROUND OF THE INVENTION

Holsters for pistols or revolvers are well established. One popular type of pistol holster is a clamshell holster that is worn at the waist or ankle of a user. A pistol slides into the clamshell holster such that the majority of the pistol is encompassed within the clamshell holster. This type holster is popular for law enforcement and military users.

In recent times, new styles of firearms have become popular. One such firearm is a pump-action firearm that is neither a rifle nor a pistol. This type firearm can be referred to as a shockwave firearm or scattergun. Examples of this type firearm include Mossberg Shockwave (Model 590) and Remington Tac 14 (Model 870). Given that these firearms have a barrel length of fourteen (14) inches, conventional pistol holsters are not able to adequately support or hold these firearms.

While rifles and shotguns can be worn over the user's shoulder or back in a pouch or carrier bag or secured to backpack, the rifles or shotguns when carried are generally difficult to access and thus the firearms are not able to be rapidly acquired and fired. Further, storing the rifles or shotguns in the pouch or carrier bag or to the backpack is also a significant effort requiring two hands.

Accordingly, there remains a need for improved ways to carry firearms, such as firearms that are pump/slide-action but shorter than full-sized rifles or shotguns (but longer than pistols), where the firearms are readily accessible to users when being carried.

SUMMARY

The invention relates to a firearm carrier that is design and configured to hold a firearm. In one embodiment, the firearm is a pump-action (or slide-action) firearm, such as a scattergun. The firearm can have a rear portion with a pistol grip, and a forward portion with a barrel and a pump-action (or slide-action) receiver. The firearm carrier can be secured to a user's waist and leg, and then the firearm can be removably secured to the firearm carrier. The firearm carrier can be configured to receive a portion of the barrel of the firearm and thereby be secured to the firearm carrier. The firearm can also be rapidly removed from the firearm carrier should the user desire to remove the firearm from the firearm carrier. The firearm carrier can also be referred to as a firearm holster.

The firearm carrier as described herein can be used in various ways. In general, a firearm is able to be secured to the firearm carrier. The firearm carrier is typically worn by a user, such as by being secured to the user's waist and leg. After the firearm carrier is secured to the user, the user is able to easily port a firearm around in a hands-free manner. However, in the event of a need or desire to make use of the firearm, the firearm can be rapidly and easily assessed and deployed. In most cases, the firearm can be released from the firearm carrier (and then deployed) using a single hand, namely, the hand adjacent the user's thigh to which the firearm carrier is secured.

Embodiments of the invention can be implemented in numerous ways, including as a device, apparatus, system or method. Several embodiments of the invention are discussed below.

As a firearm carrier, such as firearm holster, designed to receive and retain a firearm, with the firearm having at least a barrel, one embodiment can, for example, include at least: a leg mountable structure; at least one leg pad attachment member configured to secure the leg mountable structure to a user's leg; and a barrel attachment member attached to the leg mountable structure and configured to retain the firearm to the firearm carrier via a portion of the barrel of the firearm.

As a method for releasably securing a firearm having a barrel to a person using a firearm carrier having a leg structure, a barrel attachment structure and one or more straps, one embodiment can, for example, include at least: securing the leg structure to a leg of the person using the one or more straps; and placing a portion of the barrel of the firearm within the barrel attachment structure to removably secure the firearm to the firearm carrier.

As a barrel retention member for receiving and securing a portion of a barrel of a firearm, one embodiment can, for example, include at least an elongated member having top and bottom openings and having a side opening that extends from the top opening to the bottom opening. The top and bottom openings can be configured to allow a portion of the barrel of the firearm to slide therethrough during insertion or removal of the barrel of the firearm. The side opening can be configured to facilitate insertion or removal of the barrel of the firearm into or out of the elongated member. The elongated member can serve to secure position of the firearm while the barrel of the firearm is inserted into the elongated member.

As a firearm holster designed to receive and retain a firearm, with the firearm having at least a barrel and a rear grip, one embodiment can, for example, include at least: a thigh support; at least one thigh attachment member configured to secure the thigh support to a user's thigh; and a barrel attachment member attached to the thigh support and configured to hold the firearm to the firearm holster via at least a portion of the barrel of the firearm.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF EMBODIMENTS OF THE INVENTION

The invention relates to a firearm carrier that is design and configured to hold a firearm. In one embodiment, the firearm is a pump-action (or slide-action) firearm, such as a scattergun. The firearm can have a rear portion with a pistol grip, and a forward portion with a barrel and a pump-action (or slide-action) receiver. The firearm carrier can be secured to a user's waist and leg, and then the firearm can be removably secured to the firearm carrier. The firearm carrier can be configured to receive a portion of the barrel of the firearm and thereby be secured to the firearm carrier. The firearm can also be rapidly removed from the firearm carrier should the user desire to remove the firearm from the firearm carrier. The firearm carrier can also be referred to as a firearm holster.

The firearm carrier as described herein can be used in various ways. In general, a firearm is able to be secured to the firearm carrier. The firearm carrier is typically worn by a user, such as by being secured to the user's waist and leg. After the firearm carrier is secured to the user, the user is able to easily port a firearm around in a hands-free manner. However, in the event of a need or desire to make use of the firearm, the firearm can be rapidly and easily assessed and deployed. In most cases, the firearm can be released from the firearm carrier (and then deployed) using a single hand, namely, the hand adjacent the user's thigh to which the firearm carrier is secured.

The firearm carrier according to embodiments discussed herein advantageously can be a quick-release holster offered for a firearm, such as a scattergun. The firearm carrier is also suitable for safely securing the firearm to the firearm carrier, even in a loaded state if so desired. Further, the firearm carrier yields tactical advantages because it allows a user to withdraw the firearm from the firearm carrier within a single hand. Still further, the firearm carrier can advantageously allow a user to carry a firearm, such as a scattergun, with the firearm's grip being provided at waist level, thereby allowing a user to set their grip on the firearm's grip while the firearm is retained by the firearm carrier. Additionally, in such scenario, the user can also simultaneously or immediately disengage a safety strap (e.g., thumb safety strap) and proceed with one-handed presentation of firearm. Furthermore, the firearm carrier can be weather resistant and made from durable materials.

Embodiments of the invention are discussed below with reference to FIGS. 1-7. However, those skilled in the art will readily appreciate that the detailed description given herein with respect to these figures is for explanatory purposes as the invention extends beyond these limited embodiments.

Figure 1:
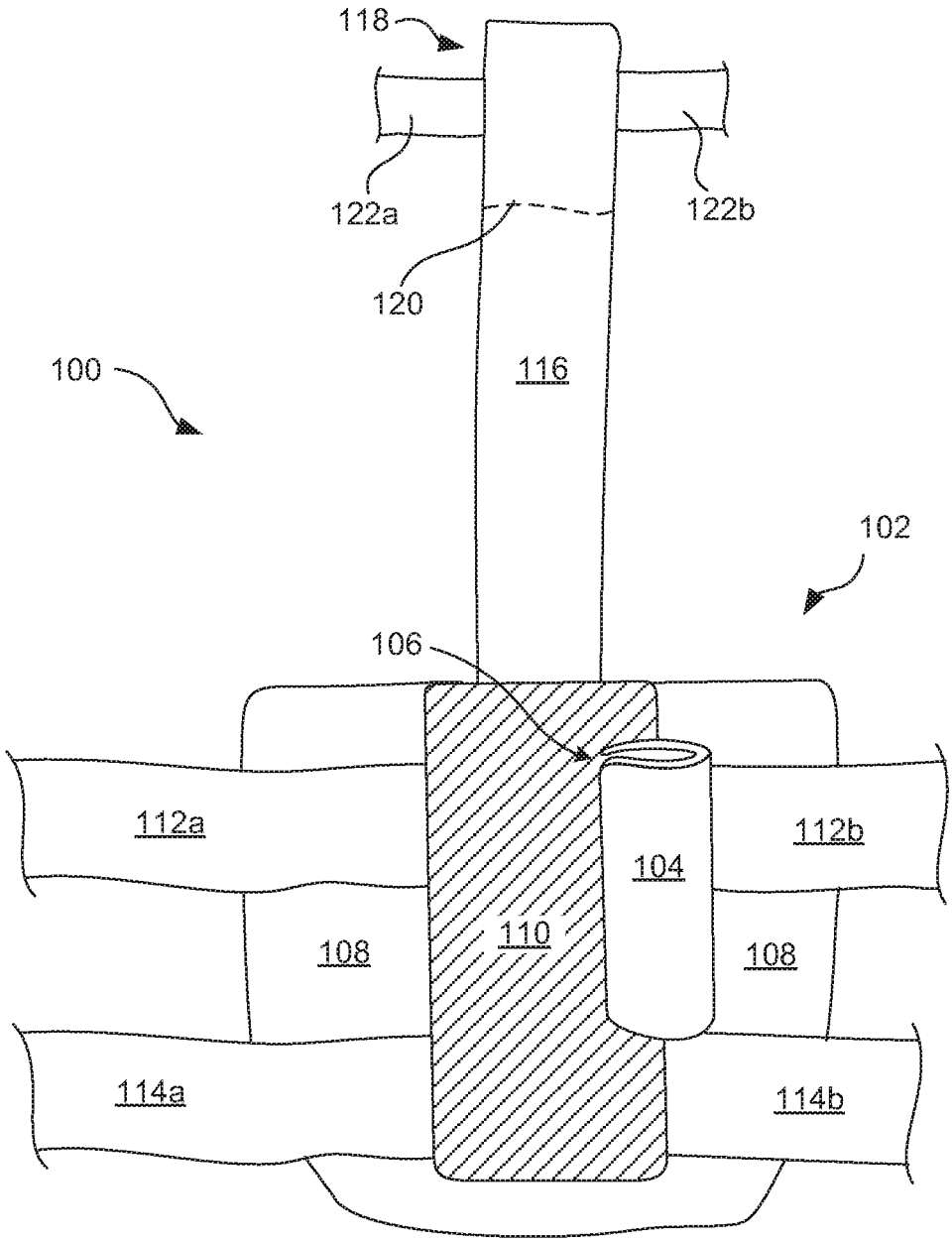
FIG. 1 is a front view of a firearm carrier according to one embodiment.

FIG. 1 is a front view of a firearm carrier 100 according to one embodiment. The firearm carrier 100 can be secured to a user, such as being secured to a user's waist and leg. The firearm carrier 100 serves to hold a firearm.

The type of firearm being held by the firearm carrier 100 can vary. One particularly suitable firearm for being held in the firearm carrier 100 is a pump-action (or slide-action) firearm. This type of firearm can have a rear portion with a pistol grip, and a forward portion with a barrel and a pump-action (or slide-action) receiver. This type firearm can be referred to as a shockwave firearm or scattergun. Specific examples of this type firearm presently in the market include Mossberg Shockwave (e.g., Model 590) and Remington Tac 14 (e.g., Model 870) and have a barrel length of fourteen (14) inches.

The firearm carrier 100 includes a leg mountable structure 102 and a barrel attachment member 104. The barrel attachment member 104 can be secured (e.g., directly or indirectly) to the leg mountable structure 102. The barrel attachment member 104 can receive a portion of the barrel of a firearm and thereby secure the firearm, in a removable way, to the firearm carrier 100.

The barrel attachment member 104 can have an elongated tube-shape with an opening 106 along one side. The opening 106 facilitates the insertion or removal of the firearm to or from the firearm carrier 100. The barrel attachment member 104 is configured to receive a portion of the barrel of the firearm and thereby secures the firearm to the firearm carrier 100 after receiving the portion of the barrel.

In one implementation, the barrel attachment member 104 is configured to have an internal engaging surface that conforms to an external barrel configuration of a portion of the barrel of the firearm. For different firearms, the barrel attachment member 104 can differ. For example, the height of the barrel attachment member 104 can vary. As another example, the internal engaging surface of the barrel attachment member 104 can differ. As still another example, the size and/or configuration of the opening 106 in the barrel attachment member 104 can vary. One particular example of a barrel attachment member is illustrated below in FIGS.

5A-5H, and another particular example of a barrel attachment member is illustrated below in FIGS. 6A-6G.

The leg mountable structure 102 can include a leg pad 108 and a base plate 110. The base plate 110 can be attached to the leg pad 108. In one implementation, the base plate 110 is a more rigid material than the leg pad 108. The base plate 110 can provide a supporting structure for the barrel attachment member 104. For example, as shown in FIG. 1, the barrel attachment member 104 can be secured adjacent to the base plate 110, and the base plate 110 can be secured adjacent the leg pad 108.

The leg pad 108 is designed to be secured to the user's thigh. One or more straps 112, 114 (including strap portions 112*a*, 112*b*, 114*a*, 114*b*) can be used to secure the leg pad 108 and thus the leg mountable structure 102 to the user's thigh. The straps 112, 114 can make use of any of a variety of securing mechanisms, such as Velcro (loop & hooks), snap, buckle, hook, clasp, etc.

The leg mountable structure 102 is provided at a lower portion of the firearm carrier 100. An upper portion of the firearm carrier 100 can be provided to secure the firearm carrier 100 to a user's waist and/or to support a rear portion of the firearm. The rear portion of the firearm can, for example, include a pistol style grip. The upper portion can include a vertical belt strap 116 having a belt loop 118. The user can secure the upper portion of the firearm carrier 100 to the user's waist by wearing a belt that passes through the belt loop 118. To adjust for different size users and/or firearms, the height of the vertical belt strap 116 can be adjustable by any of a variety of means, such as Velcro, snap, buckle, screw, clasp, screw, bolt, adhesive, etc. For example, the belt loop 118 can be formed by a fold at the top of the vertical belt strap 116, and an end 120 of the folded portion can secured against the vertical belt strap 116 by any of a variety of means, such as Velcro, snap, buckle, screw, clasp, screw, bolt, adhesive, etc.

Additionally, the upper portion of the firearm carrier 100 can also include a safety strap 122 having connectable strap ends 122*a*, 122*b*. The strap ends 122*a*, 122*b* can make use of any of a variety of releasable securing mechanisms, such as Velcro, snaps, buckles, clasps etc. The safety strap 122 is configured to removably secure the rear portion of the firearm (e.g., such as its pistol grip) to the upper portion of the firearm carrier 100. In one implementation, the safety strap ends 122*a*, 122*b* are removably secured together to secure the rear portion of the firearm (e.g., such as its pistol grip) to the upper portion of the firearm carrier 100. However, once the safety strap ends 122*a*, 122*b* are secured together, the safety strap ends 122*a*, 122*b* can be separated by the user with relative ease. For example, with one hand, a user can quickly separate the safety straps 122*a*, 122*b* and release the rear portion of the firearm from the upper portion of the firearm carrier 100.

Figure 2A:
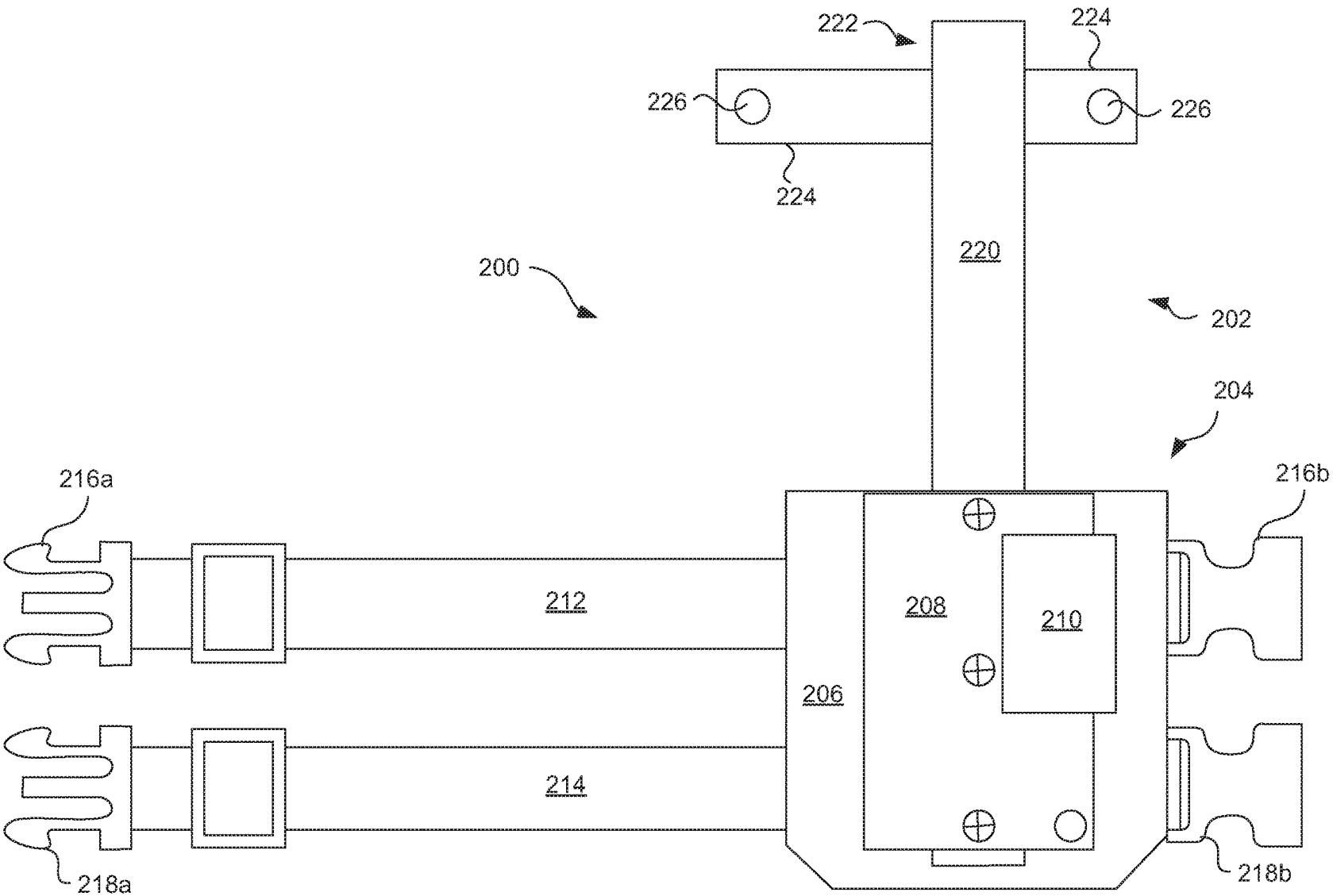
FIG. 2A is an exterior side view of a firearm carrier according to one embodiment.

FIG. 2A is an exterior side view of a firearm carrier 200 according to one embodiment. The firearm carrier 200 can represent one embodiment of the fire arm carrier 100 illustrated in FIG. 1.

The firearm carrier 200 can include an upper portion 202 and a lower portion 204. The firearm carrier 200 operates to receive and secure a firearm. In other words, a firearm can be carried by the firearm carrier 200 that is worn by a user. Typically, the firearm carrier 200 is worn around and secured to a leg of a user. For example, the firearm carrier 200 can be secured to a thigh portion of a user's leg as well as to a user's waist (e.g., via a belt).

The lower portion 204 of the firearm carrier 200 can include a pad 206 that can serve to abut against a user's leg when the firearm carrier 200 is being worn. The pad 206 can provide a compliant surface that can conform to the configuration of the user's leg. The pad 206 also offers added comfort for the user while wearing the firearm carrier 200. The pad 206 can, for example, be a fabric encased foam pad. A base plate 208 can be secured to the pad 206. The base plate 208 is typically more rigid than the pad 206. The base plate 208 can, for example, be made of plastic, glass, metal, foam board and/or cardboard. The base plate 208 provides a supporting structure for a barrel attachment member 210, which in this embodiment can be referred to as a barrel shroud 210.

The barrel shroud 210 can be secured to the base plate 208. In one embodiment, the barrel shroud 210 can be secured to the base plate 208 using any of a variety of ways, such as screws, bolts, snaps, tracks, adhesive, etc. In one implementation, the barrel shroud 210 can be repositionable relative to the base plate 208. The repositioning can enable the user to customize the vertical position of the barrel shroud 210 relative to the base plate 208, which thereby permits the user to adjust the position of a firearm (while coupled to the firearm carrier 200) relative to the user's body.

The lower portion 204 of the firearm carrier 200 can also include one or more straps that facilitate securing the firearm carrier 200 to the user, namely, to a leg of the user. As shown in FIG. 2A, the firearm carrier 200 can include a first strap 212 and a second strap 214. A first end of the first strap 212 can be coupled to a first side of the pad 206, and a second end of the first strap 212 can be coupled to a male-side connector 216*a*. A female-side connector 216*b* can be coupled to an opposite side of the pad 206 (directly or via a strap). The female-side connector 216*b* is able to mate with the male-side connector 216*a* when the first strap 212 is position around the user's leg. A first end of the second strap 214 can be coupled to the first side of the pad 206, and a second end of the second strap 214 can be coupled to a male-side connector 218*a*. A female-side connector 218*b* can be coupled to an opposite side of the pad 206 (directly or via a strap). The female-side connector 218*b* is able to mate with the male-side connector 218*a* when the second strap 214 is position around the user's leg.

The upper portion 202 of the firearm carrier 200 includes a belt strap 220 and a belt loop 222. The belt loop 222 provides an opening through which a belt worn by the user can be inserted. The belt strap 220 and the belt loop 222 serve to provide vertical positioning of the firearm carrier 200 with respect to the user's leg. In one implementation, the height of the belt strap 220 can be adjustable so that the user is able to customize the vertical positioning of the firearm carrier 200 relative to the user's leg or body.

The upper portion 202 can also include a safety strap 224. The safety strap 224 can be secured to an upper portion of the belt strap 220. When a firearm is being carried by the firearm carrier 200, opposing ends the safety strap 224 can wrap around a portion of the firearm (e.g., a handgrip or pistol grip) and be secured together. As shown in FIG. 2A, the opposing ends of the safety strap 224 can include a securing member 226. The securing member 226 can use any of a variety of different mechanical structures (e.g., Velcro (hook & loops), latch, snap, clasp, fastener, etc.). One suitable mechanical structure for the securing member(s) 226 is a snap having counterpart portions secured to opposing ends of the safety strap 224.

Figure 2B:
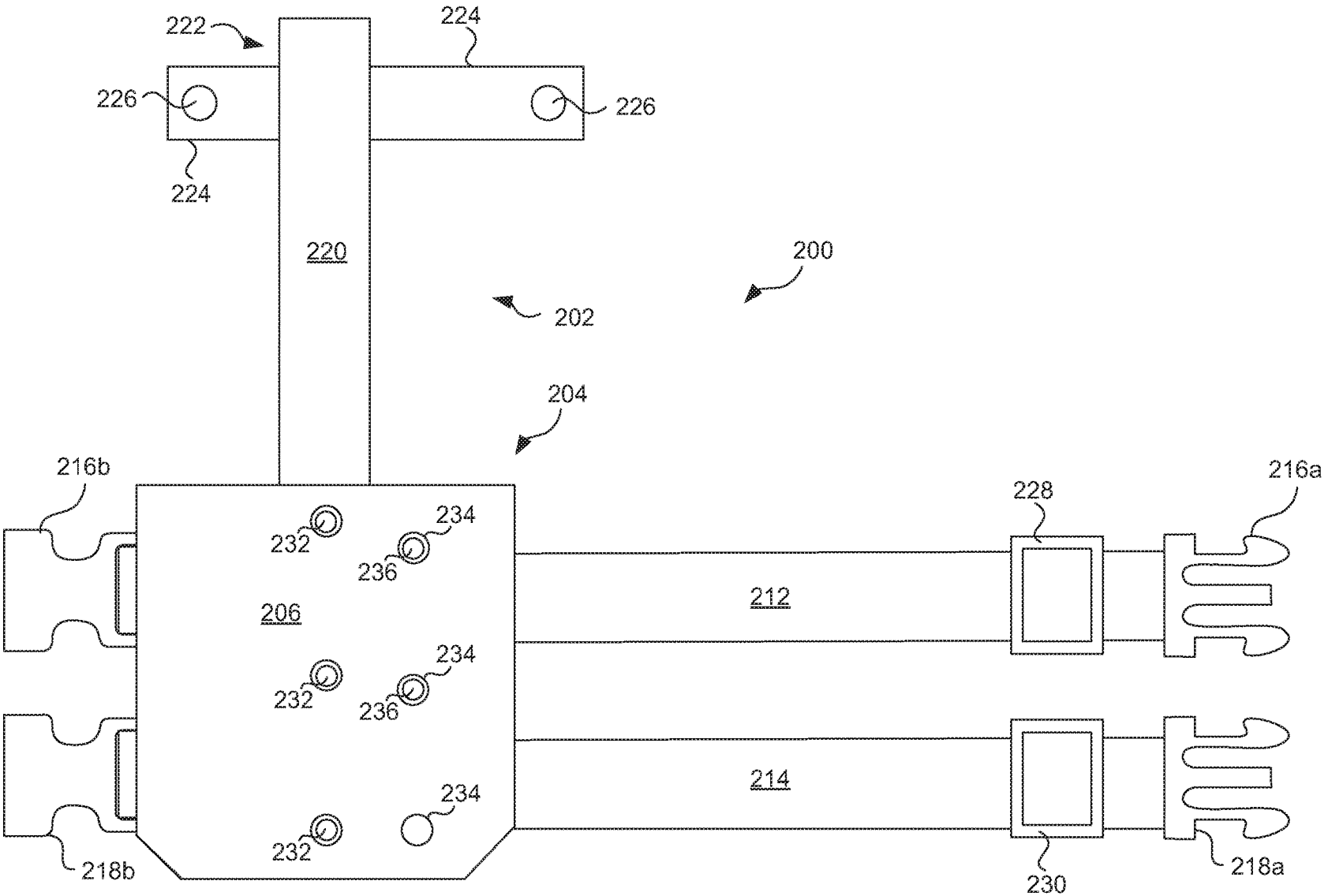
FIG. 2B is an interior side view of the firearm carrier according to the embodiment shown in FIG. 2A.

FIG. 2B is an interior side view of the firearm carrier 200 according to the embodiment shown in FIG. 2A. The first strap 212 can include a length adjuster 228 to allow the user to configure the length of the first strap 212. The second strap 214 can include a length adjuster 230 to allow the user to configure the length of the second strap 214. Additionally, the firearm carrier 200 can also have securing member 232 (e.g., screws (Chicago screws), bolts, snaps, rivets, etc.) that extend through the pad 206, the base plate 208 and the belt strap 220 to secure together these components. The base plate 208 can also have openings 234 that extend therethrough and which can receive securing members 236 to secure the barrel shroud 210 to the base plate 208. There can be extra openings 234 to facilitate repositioning of the barrel shroud 210 on the base plate 208. As shown in FIG. 2A, the barrel shroud 210 is in an upper location using the upper two openings 234 to secure the barrel shroud 210 to the base plate 208.

Figure 2C:
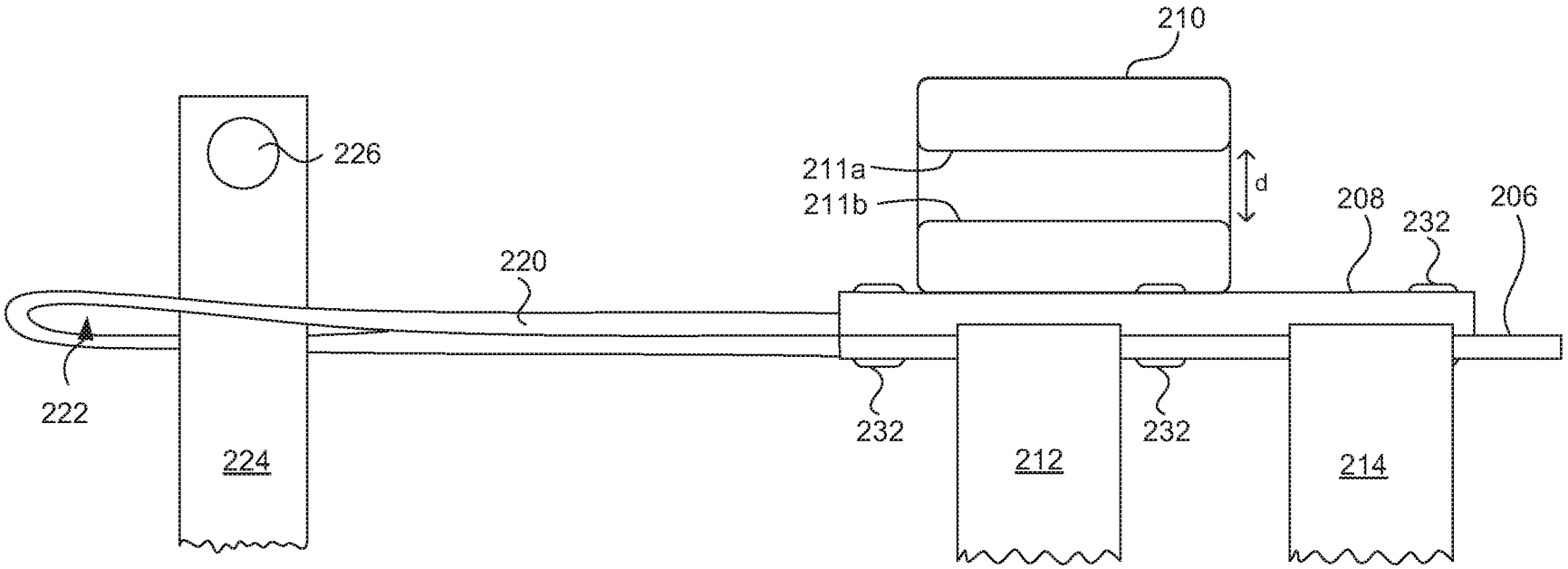
FIG. 2C is a rear side view of the firearm carrier according to the embodiment shown in FIG. 2A.

FIG. 2C is a rear side view of the firearm carrier 200 according to the embodiment shown in FIG. 2A. As shown in FIG. 2C, the barrel shroud 210 can include a slot 211 that extends from the upper end to the lower end. The slot 211 can have opposing sides 211*a* and 211*b* that are separated by a distance d, thereby forming an opening in the barrel shroud 210. In one embodiment, the slot 211 can have a uniform opening where the opening distance d is the same at the upper end and the lower end of the barrel shroud 210. For example, the barrel shroud 210 can have a height of about 4 inches and an opening distance d of about ⅞ inches.

In another embodiment, although not shown in FIG. 2A, the slot 211 have a non-uniform opening where the opening distance d is different at the upper end than the lower end of the barrel shroud 210. For example, the opening distance d can be slightly greater at the upper end than the lower end (which can provides a tapering), which can facilitate removal and securing a barrel to the barrel shroud 210.

Figure 3A:
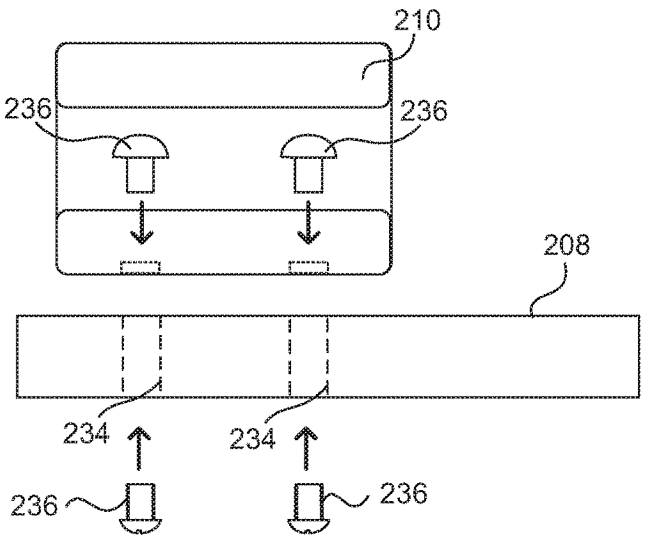
FIG. 3A is a first exemplary partial assembly diagram of a firearm carrier, such as the firearm carrier illustrated in FIGS. 2A-2C.

FIG. 3A is a first exemplary partial assembly diagram of a firearm carrier, such as the firearm carrier 200 illustrated in FIGS. 2A-2C. The first exemplary partial assembly diagram is illustrated from a rear side view. In the first exemplary assembly diagram, the barrel shroud 210 is being affixed to the base plate 208 by a pair of the securing members 236 (e.g., Chicago screws) provided through the openings 234 in the base plate 208.

Figure 3B:
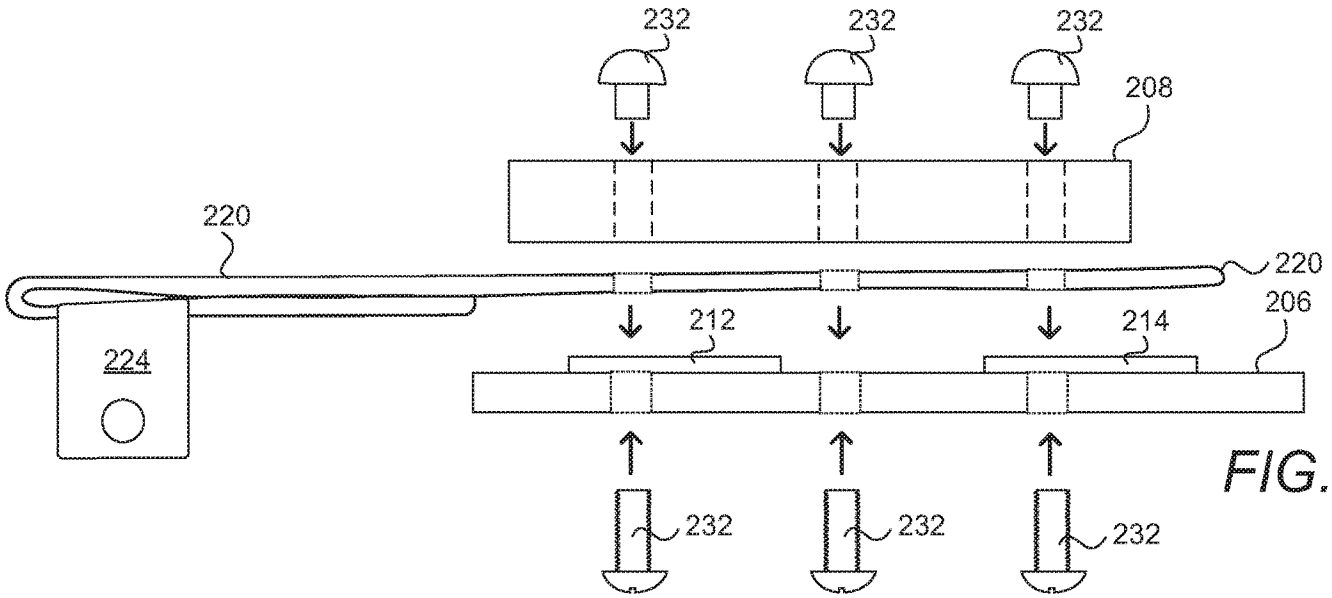
FIG. 3B is a second exemplary partial assembly diagram of a firearm carrier, such as the firearm carrier illustrated in FIGS. 2A-2C.

FIG. 3B is a second exemplary partial assembly diagram of a firearm carrier, such as the firearm carrier 200 illustrated in FIGS. 2A-2C. The second exemplary partial assembly diagram is illustrated from a rear side view. In the second exemplary assembly diagram, the pad 206 and the base plate 208 are affixed together and to the belt strap 220 by a set of three of the securing members 232 (e.g., Chicago screws) provided through openings in the base plate 208, the belt strap 200 and through the pad 206. In this example, the belt strap 220 is a Velcro-backed strap (at least partially) that can fold over and secure on itself to form a belt loop and/or to permit size adjustments for the height of the belt strap 220.

Figure 4A:
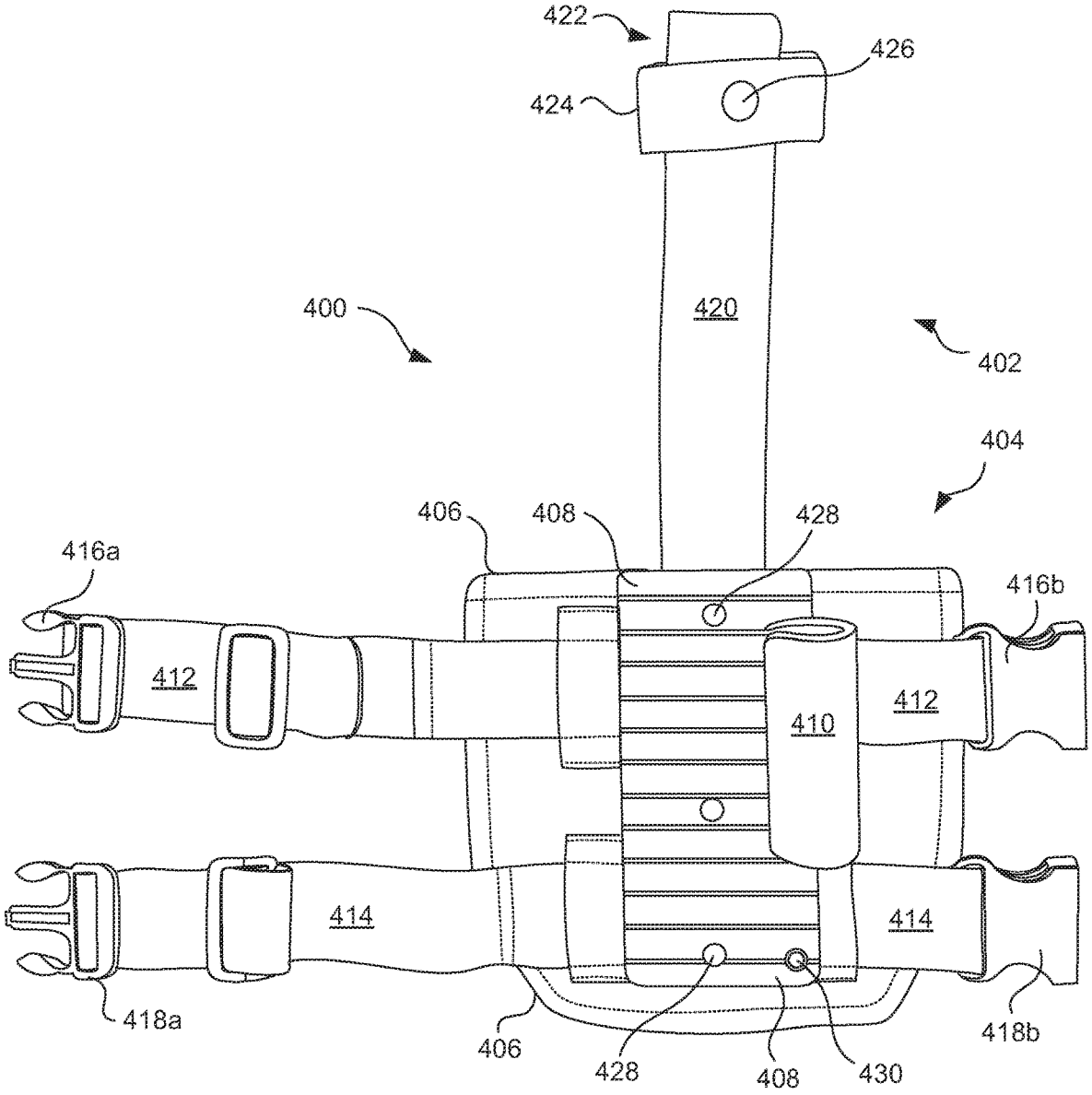
FIG. 4A is an exterior side view of a firearm carrier according to the embodiment shown in FIG. 4A.

FIG. 4A is an exterior side view of a firearm carrier 400 according to one embodiment. The firearm carrier 400 can include an upper portion 402 and a lower portion 404. The firearm carrier 400 operates to receive and secure a firearm. In other words, a firearm can be carried by the firearm carrier 400 that is worn by a user. Typically, the firearm carrier 400 is worn around and secured to a leg of a user. For example, the firearm carrier 400 can be secured to a thigh portion of a user's leg as well as to a user's waist (e.g., via a belt).

The lower portion 404 of the firearm carrier 400 can include a pad 406 that can serve to abut against a user's leg when the firearm carrier 400 is being worn. The pad 406 can provide a compliant surface that can conform to the configuration of the user's leg. The pad 406 also offers added comfort for the user while wearing the firearm carrier 400. The pad 406 can, for example, be a fabric encased foam pad.

A base plate 408 can be secured to the pad 406. The base plate 408 is typically more rigid than the pad 406. The base plate 408 can, for example, be made of plastic, glass, metal, foam board and/or cardboard. The base plate 408 provides a supporting structure for a barrel attachment member 410, which in this embodiment can be referred to as a barrel shroud 410.

The barrel shroud 410 can be secured to the base plate 408. In one embodiment, the barrel shroud 410 can be secured to the base plate 408 using any of a variety of ways, such as screws, bolts, snaps, tracks, adhesive, etc. In one implementation, the barrel shroud 410 can be repositionable relative to the base plate 408. The repositioning can enable the user to customize the vertical position of the barrel shroud 410 relative to the base plate 408, which thereby permits the user to adjust the position of a firearm (while coupled to the firearm carrier 400) relative to the user's body.

The lower portion 404 of the firearm carrier 400 can also include one or more straps that facilitate securing the firearm carrier 400 to the user, namely, to a leg of the user. As shown in FIG. 4A, the firearm carrier 400 can include a first strap 412 and a second strap 414. A central portion of the first strap 412 can be coupled to a central portion of the pad 406, such as being secured between the base plate 408 and the pad 406. The first strap 412 can be secured to the base plate 408 and/or the pad 406 using stitching, adhesive, fasteners, screws, bolts, Velcro (hooks & loops), etc. The first strap 412 can also have an adjustable length. Similarly, a central portion of the second strap 414 can be coupled to a central portion of the pad 406, such as being secured between the base plate 408 and the pad 406. The second strap 414 can be secured to the base plate 408 and/or the pad 406 using stitching, adhesive, fasteners, screws, bolts, Velcro (hooks & loops), etc. The second strap 414 can also have an adjustable length.

Additionally, a male-side connector 416*a* can be coupled to one end of the first strap 412, and a female-side connector 416*b* can be coupled to an opposite end of the first strap 412. The female-side connector 416*b* is able to mate with the male-side connector 416*a* when the first strap 412 is position around the user's leg. Also, a male-side connector 418*a* can be coupled to one end of the second strap 414, and a female-side connector 418*b* can be coupled to an opposite end of the second strap 414. The female-side connector 418*b* is able to mate with the male-side connector 418*a* when the second strap 414 is position around the user's leg.

The upper portion 402 of the firearm carrier 400 includes a belt strap 420 and a belt loop 422. The belt loop 422 provides an opening through which a belt worn by the user can be inserted. The belt strap 420 and the belt loop 422 serve to provide vertical positioning of the firearm carrier 400 with respect to the user's leg. In one implementation, the height of the belt strap 420 can be adjustable so that the user is able to customize the vertical positioning of the firearm carrier 400 relative to the user's leg or body.

The upper portion 402 can also include a safety strap 424. The safety strap 424 can be secured to an upper portion of the belt strap 420. For example, the safety strap 424 can be sewn to the belt strap 420. As other example, the safety strap 424 can secured to the belt strap 420 by a bolt, screw, adhesive, snap, etc. When a firearm is being carried by the firearm carrier 400, opposing ends the safety strap 424 can wrap around a portion of the firearm (e.g., a handgrip or pistol grip) and be secured together. As shown in FIG. 4A, the opposing ends of the safety strap 424 can be secured together using a securing member 426. The securing member 426 can use any of a variety of different mechanical structures (e.g., Velcro (hook & loops), latch, snap, fastener, etc.). One suitable mechanical structure for the securing member(s) 426 is a snap having counterpart portions secured to opposing ends of the safety strap 424.

Figure 4B:
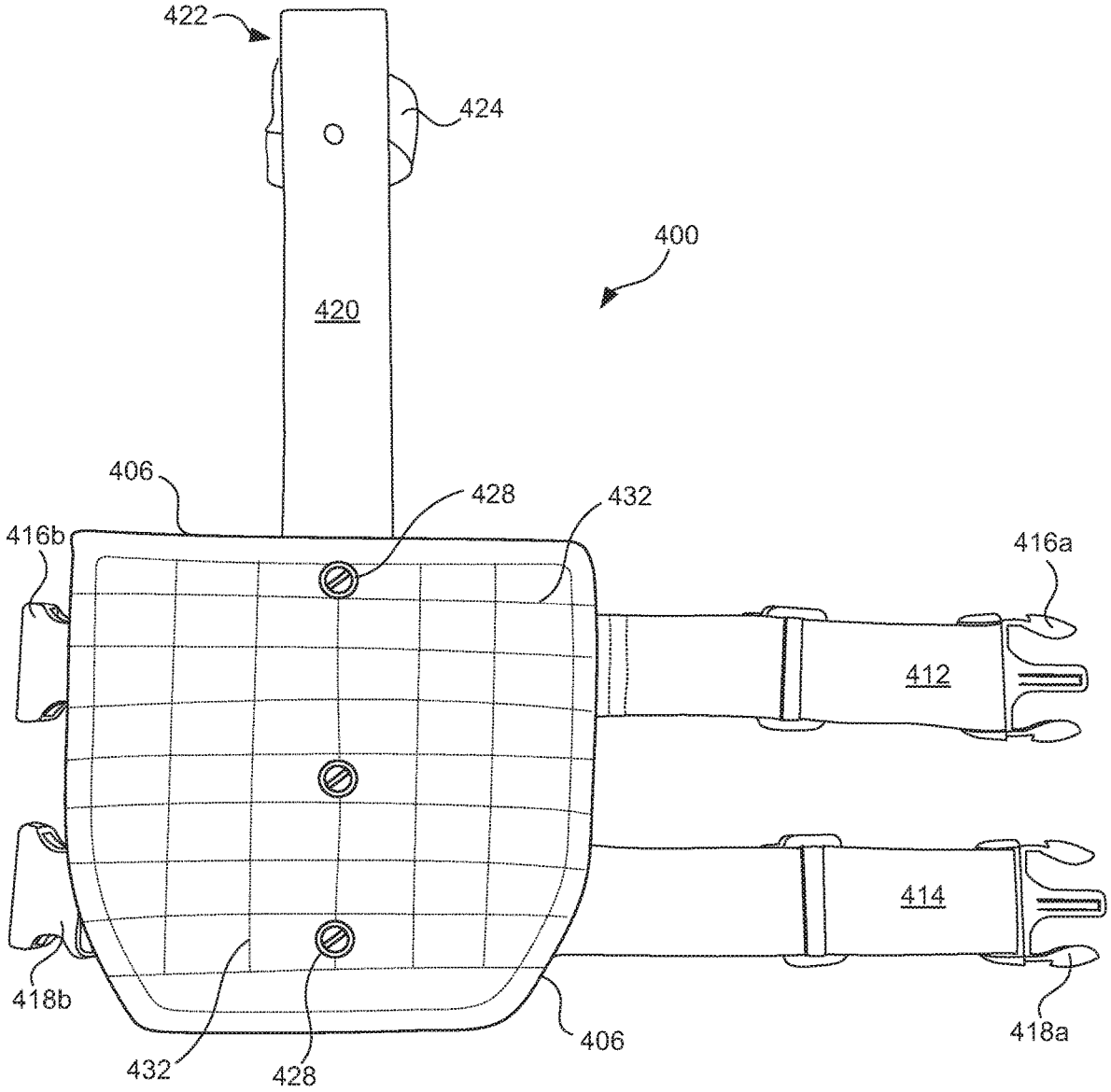
FIG. 4B is an interior side view of the firearm carrier according to the embodiment shown in FIG. 4A.

FIG. 4B is an interior side view of the firearm carrier 400 according to one embodiment. The pad 406 can further include securing members, such as screws or bolts 428, that can secure the base plate 408 and the belt strap 420 to the pad 406.

Optionally, the inside surface of the pad 406 can have a Molle surface. The Molle surface can allow the firearm carrier 400 to be mounted on other surfaces, such as a backpack.

Figure 4C:
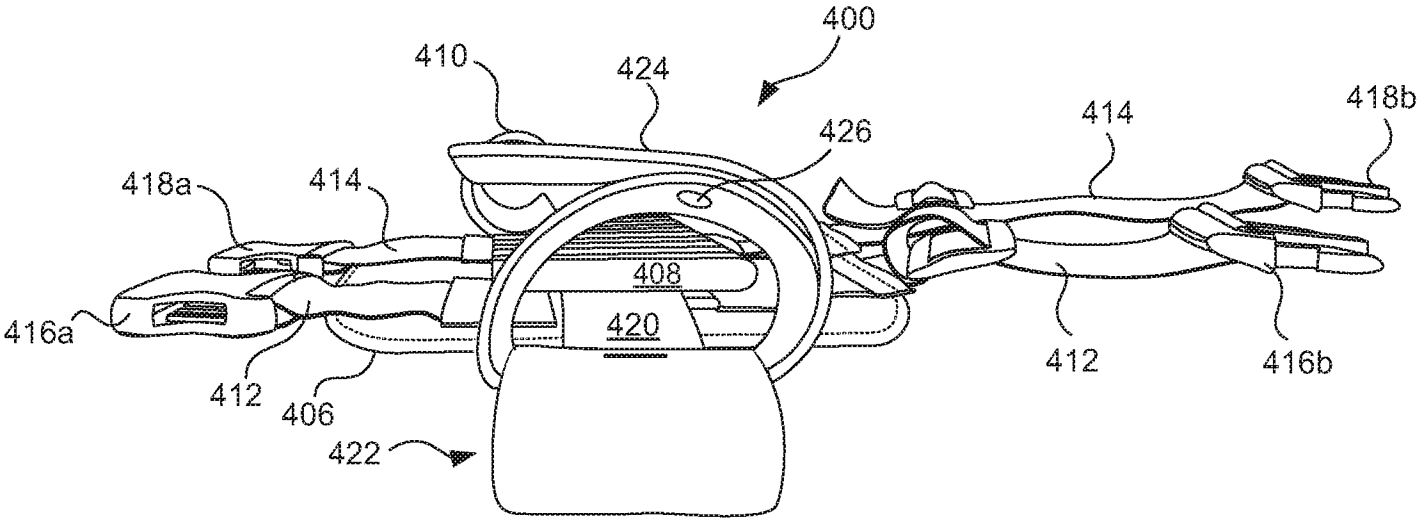
FIG. 4C is a top view of the firearm carrier according to the embodiment shown in FIG. 4A.

FIG. 4C is a top view of the firearm carrier 400 according to one embodiment. The straps 412, 414 and the connectors 416, 418 are shown in an open or unattached configuration in which the firearm carrier 400 is not secured to a user. The safety strap 424 is shown connected by the securing member 426.

Figure 4D:
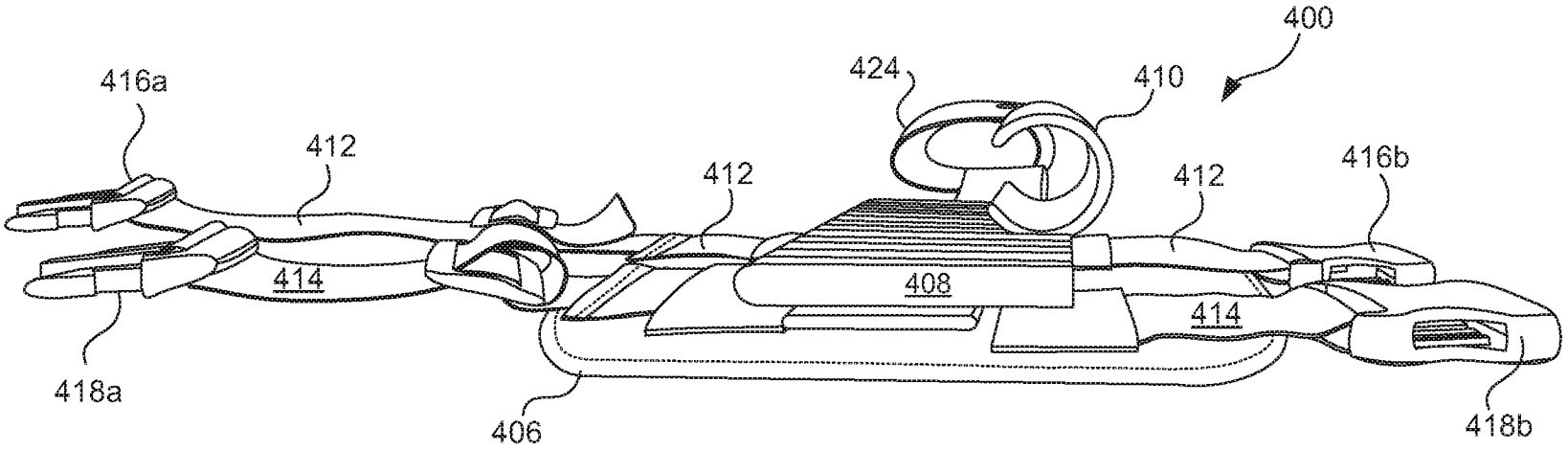
FIG. 4D is a bottom view of the firearm carrier according to the embodiment shown in FIG. 4A.

FIG. 4D is a bottom view of the firearm carrier 400 according to one embodiment. The straps 412, 414 and the connectors 416, 418 are shown in an open or unattached configuration in which the firearm carrier 400 is not secured to a user. The safety strap 424 is shown connected by the securing member 426.

Figure 4E:
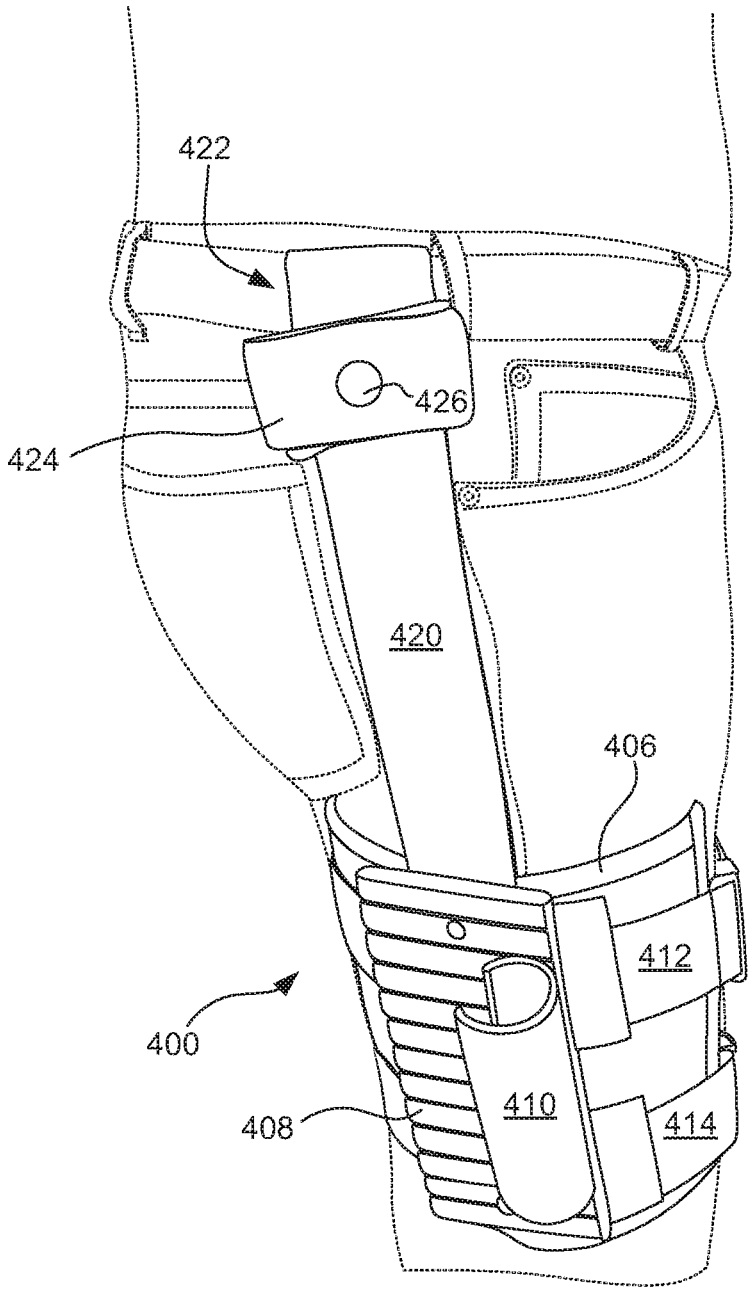
FIG. 4E is a side perspective view of the firearm carrier according to the embodiment shown in FIG. 4A.

FIG. 4E is a side perspective view of the firearm carrier 400 according to one embodiment. The straps 412, 414 and the connectors 416, 418 are shown in a closed or attached configuration in which the firearm carrier 400 is secured to a user's leg. The safety strap 424 is shown connected by the securing member 426. The belt opening 422 has a user's belt passing therethrough.

Figure 4F:
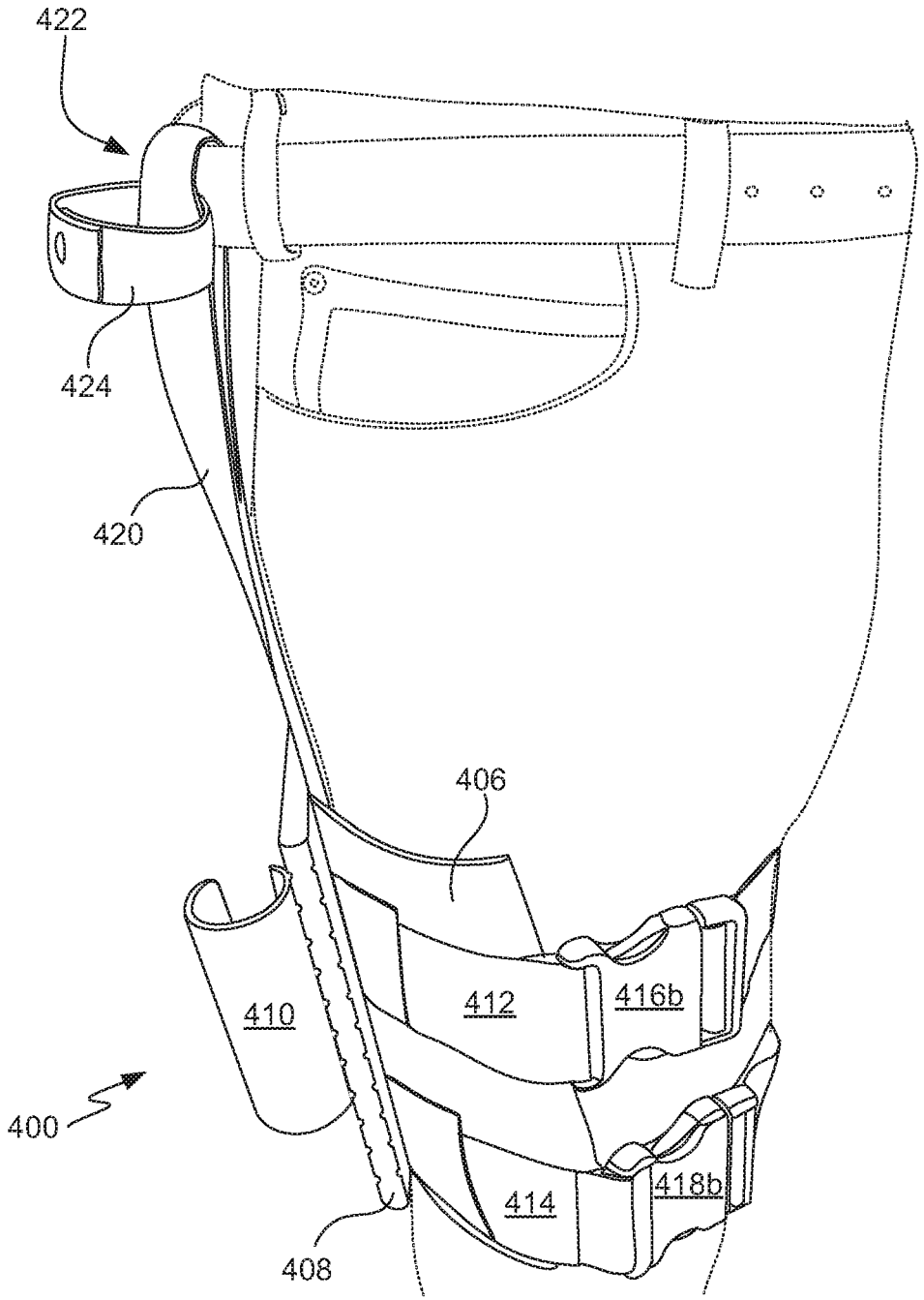
FIG. 4F is a forward perspective view of the firearm carrier according to the embodiment shown in FIG. 4A.

FIG. 4F is a forward perspective view of the firearm carrier 400 according to one embodiment. The straps 412, 414 and the connectors 416, 418 are shown in a closed or attached configuration in which the firearm carrier 400 is secured to a user's leg. The safety strap 424 is shown connected by the securing member 426. The belt opening 422 has a user's belt passing therethrough.

Figure 4G:
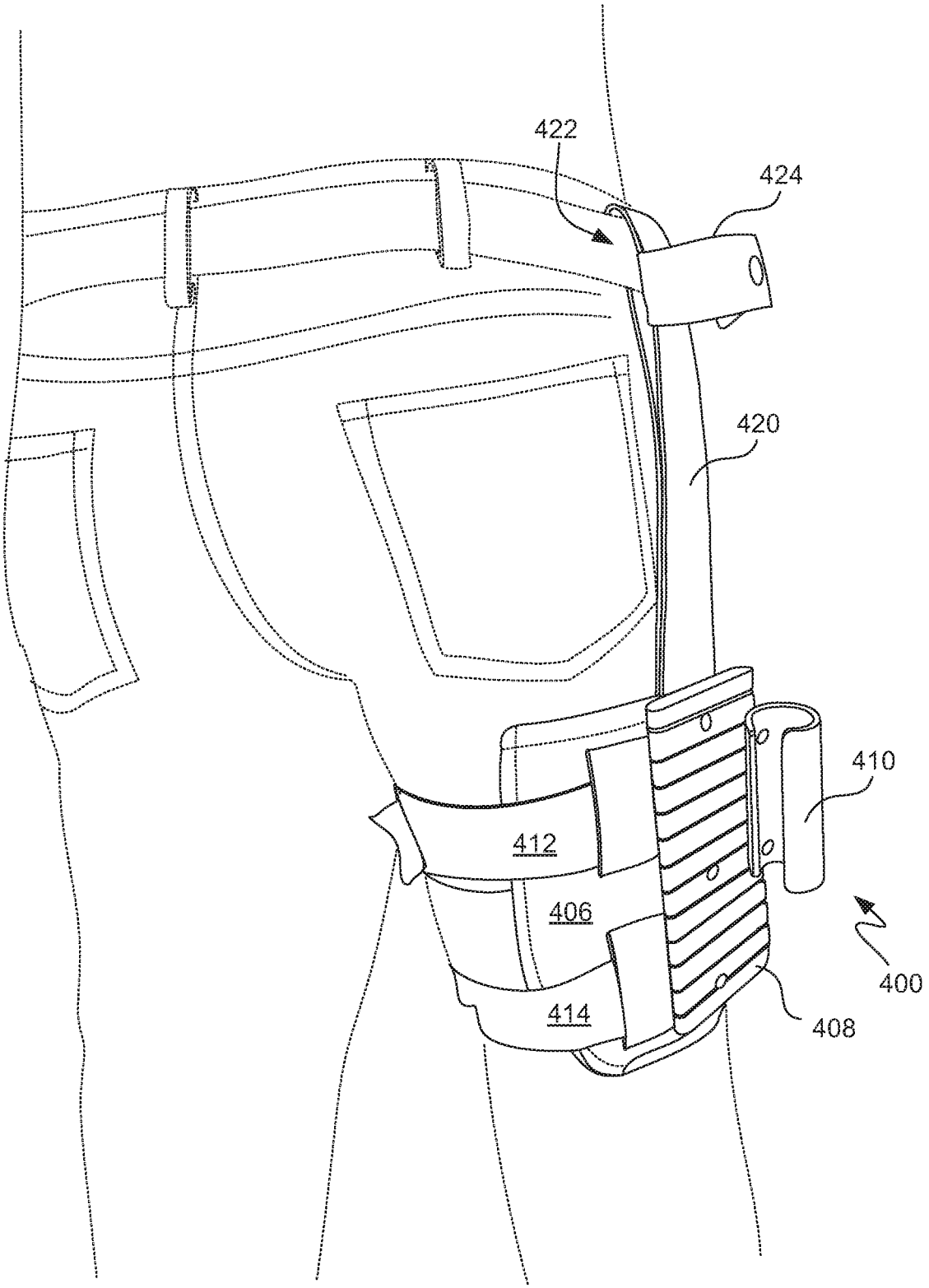
FIG. 4G is a rear perspective view of the firearm carrier according to the embodiment shown in FIG. 4A.

FIG. 4G is a rear perspective view of the firearm carrier 400 according to one embodiment. The straps 412, 414 and the connectors 416, 418 are shown in a closed or attached configuration in which the firearm carrier 400 is secured to a user's leg. The safety strap 424 is shown connected by the securing member 426. The belt opening 422 has a user's belt passing therethrough.

Figure 4H:
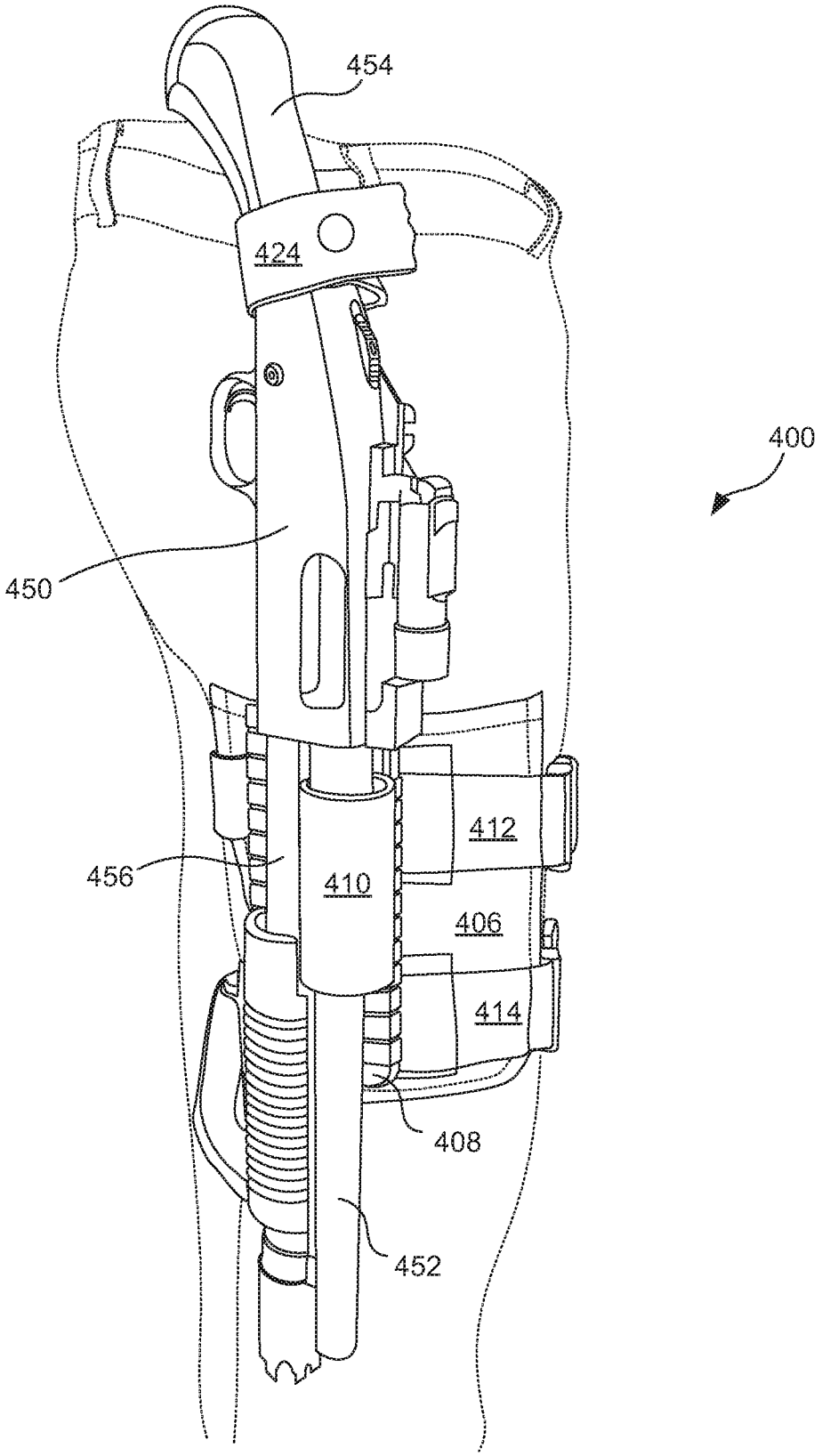
FIG. 4H is a side perspective view of the firearm carrier according to the embodiment shown in FIG. 4A.

FIG. 4H is a side perspective view of the firearm carrier 400 according to one embodiment. The straps 412, 414 and the connectors 416, 418 of the firearm carrier 400 are shown in a closed or attached configuration in which the firearm carrier 400 is secured to a user's leg. As shown in FIG. 4H, the firearm carrier 400 is carrying a firearm 450. In this exemplary embodiment, the firearm 450 is a Mossberg 590 Shockwave firearm having a barrel 452, a pistol grip 454 and a receiver 456. The firearm 450 is secured to the firearm carrier 400 by the barrel shroud 410 and the safety strap 422. The barrel shroud 410 has an opening that receives a section of the barrel 452. In one implementation, the barrel shroud 410 can has an opening that is tapered such that the upper end has a greater diameter than the lower end, which can allows the barrel to wedge against an inner surface of the opening. In one implementation, the barrel shroud 410 can have a slot that extends from the upper end to the lower end. The slot can assist with insertion and removal of the barrel 452 of the firearm 400 from the barrel shroud 410. The safety strap 424 is shown secured around the pistol grip 454 and connected by the securing member 426. The belt opening 422 has a user's belt passing therethrough.

The firearm carrier 400 can be implemented for various different sizes and materials. In one particular implementation of the firearm carrier 400 illustrated in FIGS. 4A-4H, the size and material of the components can be as follows. The pad 406 can be sized about 9¾×9½ inches and formed of nylon covered pad. Alternatively, the pad 406 could be formed of leather. The back side of the pad 406 can optionally be provided with a Molle surface. The straps 412 and 414 can be 2×19 inches and be length adjustable. The connectors 416 and 418 can be plastic buckles. The base plate 408 can be sized about 7¾×3¾×½ inches, can be form of rubber-coated cardboard material. Alternatively, the base plate 406 could be formed from various other materials, such as polymer plastic, rubber, leather, plastic, foam, etc. The barrel shroud 410 can be 4×1½ inches rubber coated PVC pipe having an opening formed lengthwise and where the width if the opening can be about ⅞ inches. Alternatively, the barrel shroud 410 can be formed from various other materials, such as plastic, metal, etc. In one embodiment, the barrel shroud 410 can be molded to a desired shape and configuration. The belt strap 420 can be about 2×29 inches and formed of nylon. The belt strap 420 can also be at least partially Velcro-based to facilitate repositioning. The safety strap 424 can be 1½×10½ inches and formed of nylon material. Alternatively, the safety strap 424 can be formed of leather. The safety strap 424 can also include a metal or plastic snap. The safety strap 424 can be sewn to the belt strap 420.

FIGS. 5A-5H are views of a barrel attachment structure according to a first embodiment. In one implementation, the barrel attachment structure can be referred to as a barrel shroud. The barrel attachment structure shown in FIGS. 5A-5H is, for example, suitable for use of the barrel attachment member 104 shown in FIG. 1, the barrel attachment member 210 shown in FIGS. 2A-2B or the barrel attachment member 410 shown in FIGS. 4A-4H.

Figure 5A:
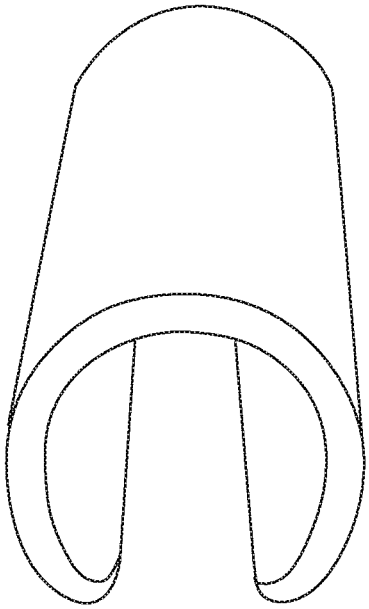
FIG. 5A is a top perspective view of a barrel attachment structure in accordance with a first embodiment.

FIG. 5A is a top perspective view of a barrel attachment structure in accordance with the first embodiment.

Figure 5B:
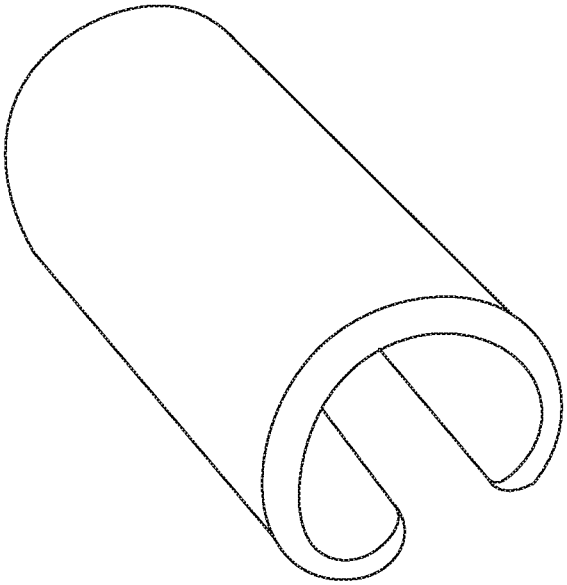
FIG. 5B is a side perspective view of a barrel attachment structure in accordance with the first embodiment.

FIG. 5B is a bottom perspective view of a barrel attachment structure in accordance with the first embodiment.

Figure 5C:
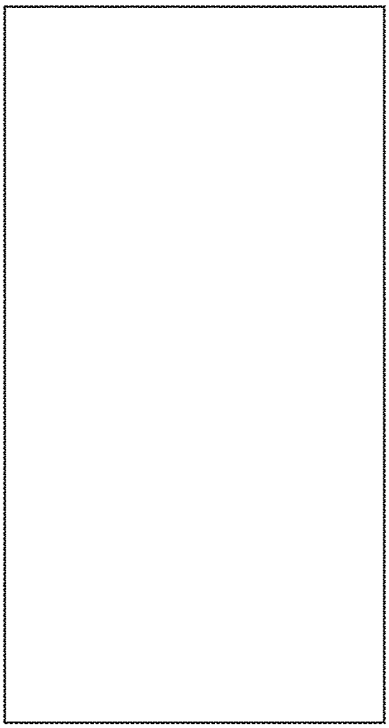
FIG. 5C is a front view for the barrel attachment structure in accordance with the first embodiment.

FIG. 5C is a front view for the barrel attachment structure in accordance with the first embodiment.

Figure 5D:
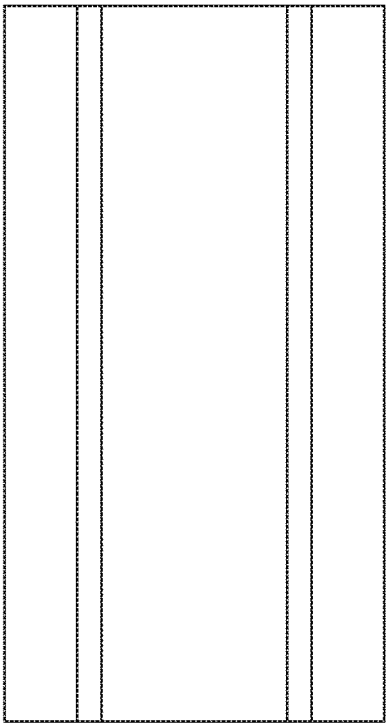
FIG. 5D is a rear view for the barrel attachment structure in accordance with the first embodiment.

FIG. 5D is a rear view for the barrel attachment structure in accordance with the first embodiment.

Figure 5E:
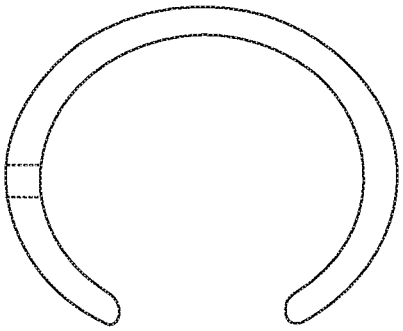
FIG. 5E is a top view for the barrel attachment structure in accordance with the first embodiment.

FIG. 5E is a top view for the barrel attachment structure in accordance with the first embodiment.

Figure 5F:
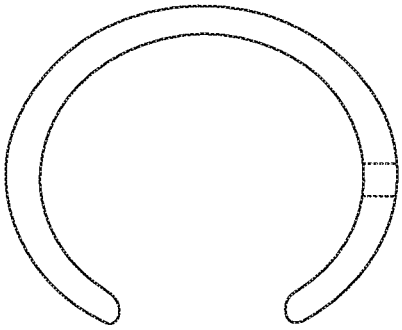
FIG. 5F is a bottom view for the barrel attachment structure in accordance with the first embodiment.

FIG. 5F is a bottom view for the barrel attachment structure in accordance with the first embodiment.

Figure 5G:
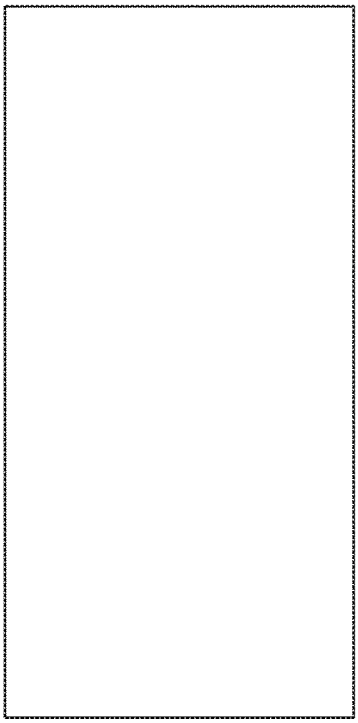
FIG. 5G is a left side view of the barrel attachment structure in accordance with the first embodiment.

FIG. 5G is a left side view of the barrel attachment structure in accordance with the first embodiment.

Figure 5H:
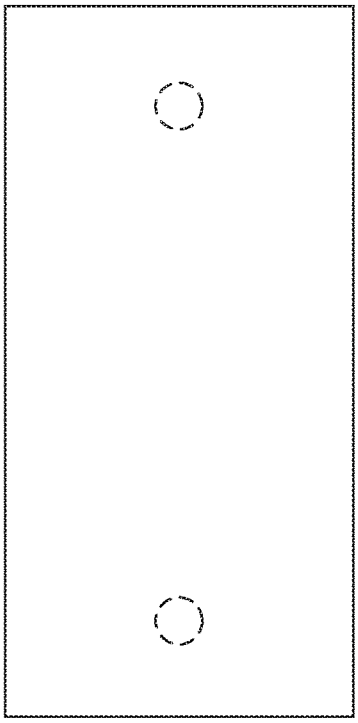
FIG. 5H is a right side view for the barrel attachment structure in accordance with the first embodiment.

FIG. 5H is a right side view for the barrel attachment structure in accordance with the first embodiment.

FIGS. 6A-6G are views of a barrel attachment structure according to a second embodiment. In one implementation, the barrel attachment structure can be referred to as a barrel shroud. The barrel attachment structure shown in FIGS. 6A-6G can, for example, suitable for use of the barrel attachment member 104 shown in FIG. 1, the barrel attachment member 210 shown in FIGS. 2A-2B or the barrel attachment member 410 shown in FIGS. 4A-4H. The barrel attachment structure shown in FIGS. 6A-6G has a different configuration because it is designed for a different firearm. In other words, the configuration of the barrel attachment structure is still for coupling to a firearm barrel, but the particular configuration is different than the configuration of the barrel attachment member 104 shown in FIG. 1, the barrel attachment member 210 shown in FIGS. 2A-2B or the barrel attachment member 410 shown in FIGS. 4A-4H. As an example, the configuration of the barrel attachment structure can be configured to couple to a barrel (and receiver) of a firearm such as the Remington Tac 14.

Figure 6A:
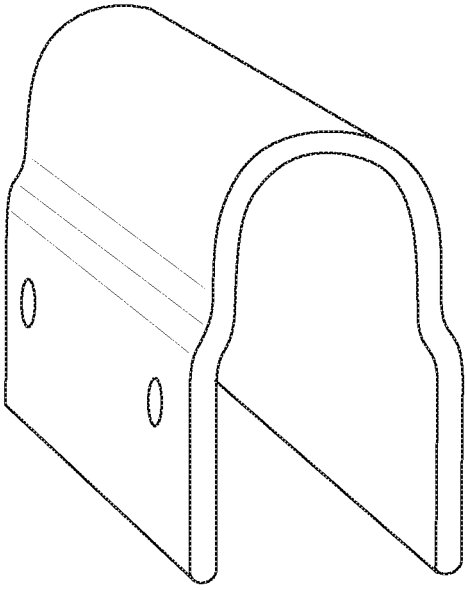
FIG. 6A is a top perspective view of a barrel attachment structure in accordance with a second embodiment.

FIG. 6A is a top perspective view of a barrel attachment structure in accordance with the second embodiment.

Figure 6B:
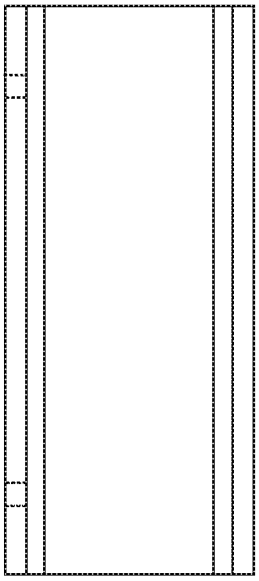
FIG. 6B is a front view for the barrel attachment structure in accordance with the second embodiment.

FIG. 6B is a front view for the barrel attachment structure in accordance with the second embodiment.

Figure 6C:
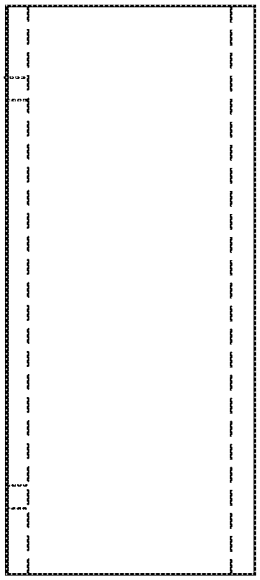
FIG. 6C is a rear view for the barrel attachment structure in accordance with the second embodiment.

FIG. 6C is a rear view for the barrel attachment structure in accordance with the second embodiment.

Figure 6D:
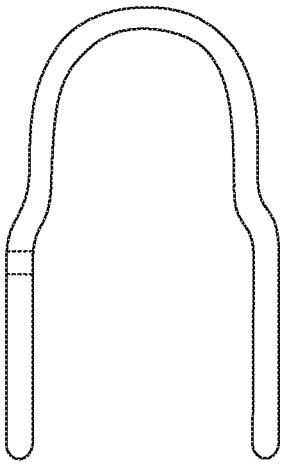
FIG. 6D is a top view for the barrel attachment structure in accordance with the second embodiment.

FIG. 6D is a top view for the barrel attachment structure in accordance with the second embodiment.

Figure 6E:
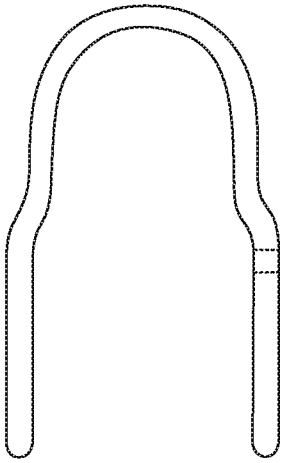
FIG. 6E is a bottom view for the barrel attachment structure in accordance with the second embodiment.

FIG. 6E is a bottom view for the barrel attachment structure in accordance with the second embodiment.

Figure 6F:
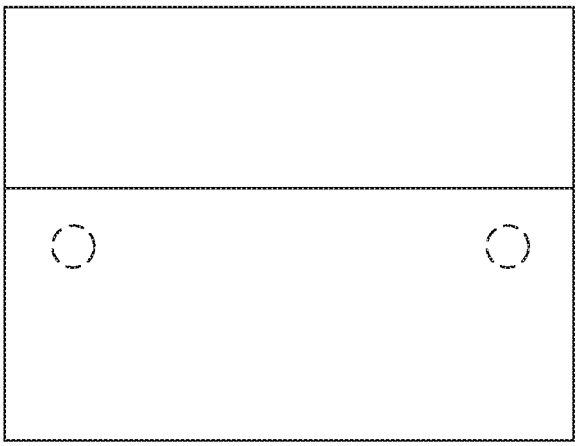
FIG. 6F is a left side view of the barrel attachment structure in accordance with the second embodiment.

FIG. 6F is a left side view of the barrel attachment structure in accordance with the second embodiment.

Figure 6G:
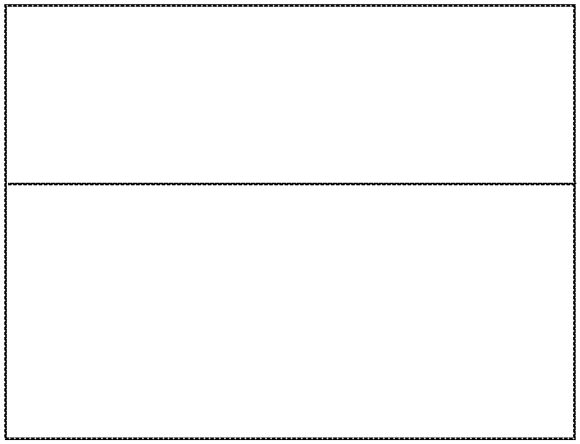
FIG. 6G is a right side view for the barrel attachment structure in accordance with the second embodiment.

FIG. 6G is a right side view for the barrel attachment structure in accordance with the second embodiment.

Figure 7:
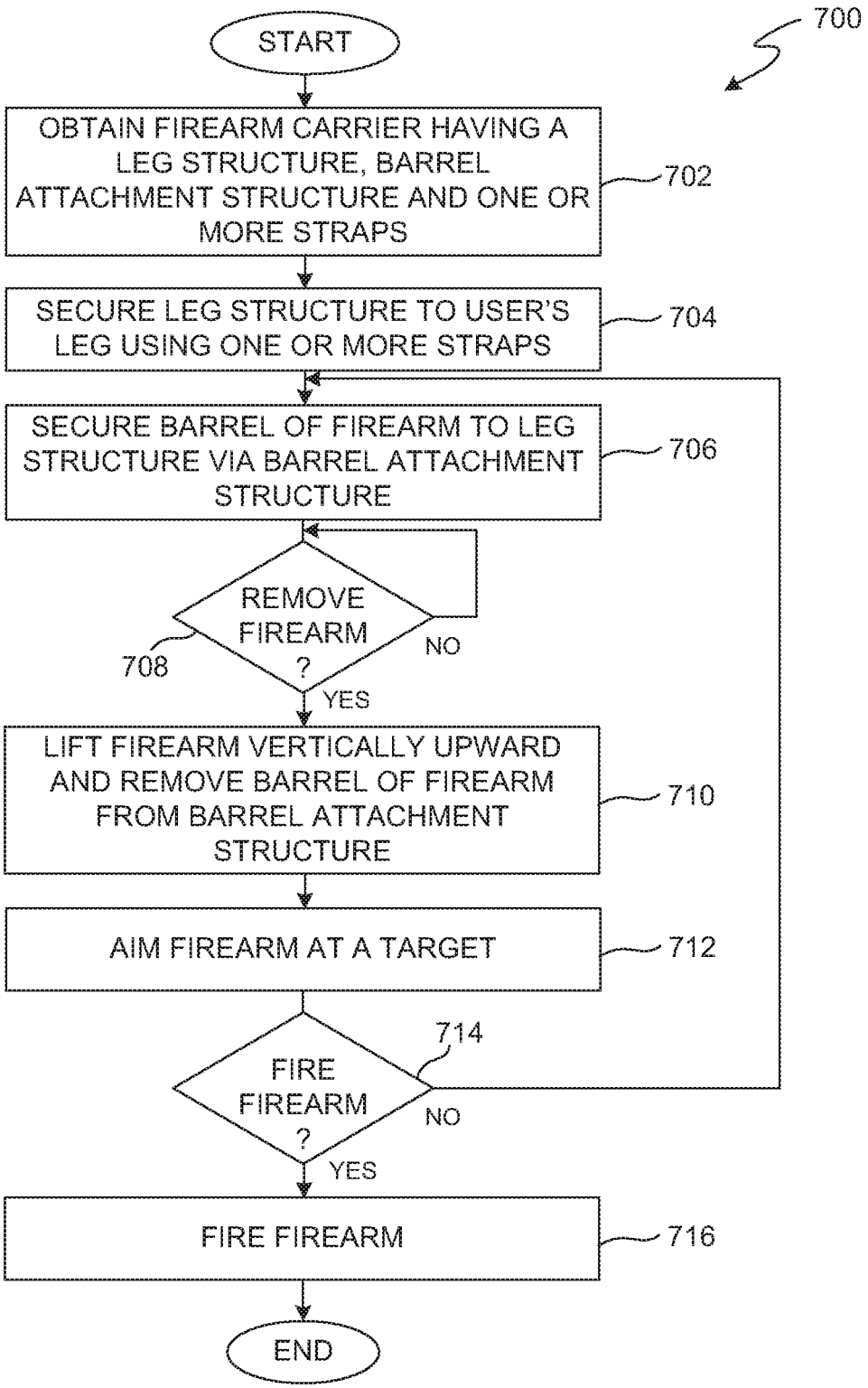
FIG. 7 is a flow diagram of a method for using a firearm carrier according to one embodiment.

FIG. 7 is a flow diagram of a method 700 for using a firearm carrier according to one embodiment. The firearm carrier can, for example, pertain to the firearm carrier 100 illustrated in FIG. 1, the firearm carrier 200 illustrated in FIG. 2A-2C, or the firearm carrier 4100 illustrated in FIGS. 4A-4H. The firearm carrier can serve to carry a firearm in a safe but also tactical manner.

The method 700 can initially obtain 702 the firearm carrier which has a leg structure, a barrel attachment structure and one or more straps. Once obtained, the firearm carrier can be secured to a user. In particular, the leg structure of the firearm carrier can be secured 704 to the user's leg (e.g., user's thigh) using the one or more straps. The firearm carrier may also have an upper portion that can be secured to the user's waist, such as via a belt.

In any case, once the firearm carrier is secured to the user, the barrel of the firearm to be secured to the firearm carrier can be secured 706 to the leg structure via the barrel attachment structure. In one implementation, a portion of the barrel of the firearm is inserted into the barrel attachment structure, and can optionally be pushed downward to wedge the barrel into the barrel attachment structure. At this point, the firearm is safely secured to the firearm carrier. However, the firearm is available to be rapidly removed from the firearm carrier by the user. Hence, the method 700 can determine whether the user desires to remove the firearm from the firearm carrier. Here, a decision 708 can be based on whether or not the firearm is to be removed from the firearm carrier. If the decision 708 determines that the firearm is not presently to be removed from the firearm carrier, then the firearm remains secured to the firearm carrier.

On the other hand, when the decision 708 determines that the firearm is presently to be removed from the firearm carrier, the user can initiate actions to remove the firearm from the firearm carrier. In removing the firearm, the method 700 provides that the user lifts 710 the firearm substantially vertically upward and removes the barrel of the firearm from the barrel attachment structure of the firearm carrier. In one implementation, the barrel attachment structure can have a vertical slot or opening to facilitate (i) entry of the firearm in the firearm holster and/or (ii) removal of the firearm from the firearm holster. Once the firearm is removed from the barrel attachment structure, then the firearm is released from the firearm carrier and can be thereafter be utilized. In one embodiment, as shown in FIG. 7, the user can aim 712 the firearm, if desired.

Next, a decision 714 can determines whether the firearm is to be fired. When the decision 714 determines that the firearm is not to be fired, the method 700 returns to and repeats block 706 and subsequent blocks so that the firearm can be again secured 706 to the firearm carrier using the barrel attachment member. On the other hand, when the decision 714 determines that the firearm is to be fired, the firearm can be fired 716. Following the firing 716 of the firearm, the method 700 can end.

The firearm carrier is safe, comfortable and functional. One advantage of one or more embodiments of the invention is that the firearm carrier, e.g., firearm holster, can properly secure a firearm, such as a scattergun. Further, the firearm carrier can advantageously provide a fast and immediately available mode of carry. The firearm carrier can be secured to either the left or right side of a user's body without significantly substantially inhibiting body movement of the user. The firearm carrier stays in place once properly secured to a user, and thus minimizes or eliminates any undesired "holster creep." Another advantage of one or more embodiments of the invention is that the firearm carrier, e.g., firearm holster, can be conveniently adjusted to the user's size and preferences. For example, various elements of the firearm carrier can be adjusted in their position. Yet another advantage of one or more embodiments of the invention is that the user can release the safety strap and draw the firearm out of the firearm carrier with a single hand.

Still another advantage of one or more embodiments of the invention is that the firearm carrier can be adapted to support different manufacturer's firearms. Since different firearms (e.g., scatterguns) from different manufacturers have different barrels and/or different accessibility to barrels, the firearm carrier is able to adapt to serve as a carrier for the different firearms (e.g., scatterguns) from different manufacturers.

The many features and advantages of the present invention are apparent from the written description, and thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A system for use in carrying a firearm, comprising:

a firearm having at least a barrel; and a firearm carrier configured to receive and retain the firearm, the firearm carrier comprising:

a leg mountable structure;

at least one leg pad attachment member configured to secure the leg mountable structure to a user's leg; and a barrel attachment member attached to the leg mountable structure, the barrel attachment member being configured to retain the firearm to the firearm carrier via a portion of the barrel of the firearm, wherein the barrel attachment member serves to secure a position of the firearm relative to the firearm carrier while the barrel of the firearm is inserted in the barrel attachment member, wherein the leg mountable structure comprises a leg pad and a base platform, the base platform having a plurality of apertures;

wherein the base platform is secured to the leg pad and the barrel attachment member is secured to the base platform via one or more of the plurality of apertures, wherein the barrel attachment member has top and bottom openings and having a side opening that extends from the top opening to the bottom opening, wherein the top and bottom openings are configured to allow a portion of the barrel of the firearm to slide therethrough during insertion or removal of the barrel of the firearm, wherein the side opening is configured to facilitate insertion or removal of the barrel of the firearm into or out of the barrel attachment member, wherein the barrel attachment member has an internal cross-sectional configuration that has a lower region that matches a first cross-sectional configuration of at least a portion of the barrel and has an upper region that matches a second cross-sectional configuration of at least a portion of a receiver of the firearm, the first cross-sectional configuration being different than the second cross-sectional configuration, and wherein the barrel attachment member serves to secure a position of the firearm while the barrel of the firearm is inserted into the barrel attachment member, wherein the barrel attachment member has an internal cross-sectional configuration that has a lower region matches a first cross-sectional configuration of at least a portion of the barrel and has an upper region that has a second cross-sectional configuration of at least a portion of the receiver, the first cross-sectional configuration being different than the second cross-sectional configuration, and wherein when the barrel of the firearm is inserted into the barrel attachment member, the at least a portion of the barrel and the at least a portion of the receiver respectively contact against the lower region and the upper region of the internal cross-sectional configuration of the barrel attachment member.

2. A system as recited in claim 1, wherein the firearm is a pump action firearm.

3. A system as recited in claim 1, wherein the firearm has a barrel length of fourteen (14) inches.

4. A system as recited in claim 1, wherein the firearm is a scattergun.

5. A system as recited in claim 1, wherein the firearm has a rear grip.

6. A system as recited in claim 5, wherein the rear grip is a pistol grip.

7. A system as recited in claim 1, wherein the firearm has a rear grip, and wherein the firearm carrier comprises:

a rear grip retention member at an upper portion of the firearm carrier, the rear grip retention member being configured to secure the rear grip to the firearm carrier.

8. A system as recited in claim 7, wherein the rear grip retention member comprises a strap configured to secure the rear grip relative to the firearm carrier.

9. A system as recited in claim 8, wherein the rear grip retention member comprises a snap configured to removably secure the rear grip relative to the firearm carrier.

10. A system as recited in claim 1, wherein the barrel attachment member is removably attached to the leg mountable structure.

11. A system as recited in claim 1, wherein the firearm carrier is a firearm holster.

12. A system as recited in claim 1, wherein the base platform is formed from a more rigid material than the leg pad.

13. A system as recited in claim 1, wherein the barrel attachment member is repositionable relative to the base platform.

14. A firearm carrying system, comprising:

a firearm having at least a barrel; and a barrel retention member for receiving and securing a portion of a barrel of the firearm, the firearm having a receiver coupled to the barrel, the barrel retention member comprising:

an elongated member having top and bottom openings and having a side opening that extends from the top opening to the bottom opening, wherein the top and bottom openings are configured to allow a portion of the barrel of the firearm to slide therethrough during insertion or removal of the barrel of the firearm, wherein the side opening is configured to facilitate insertion or removal of the barrel of the firearm into or out of the elongated member, wherein the elongated member serves to secure a position of the firearm while the barrel of the firearm is inserted into the elongated member, wherein the elongated member has an internal cross-sectional configuration that (i) has a lower region that matches at least a first cross-sectional configuration of at least a portion of the barrel and (ii) has an upper region that matches a second cross-sectional configuration, and wherein when the barrel of the firearm is inserted into the elongated member, the at least a portion of the barrel and the at least a portion of the receiver respectively contact against the lower region and the upper region of the internal cross-sectional configuration of the elongated member.

15. A system as recited in claim 14, wherein the elongated member is formed specifically for a pump action firearm, such that the internal cross-sectional configuration matches at least (i) a cross-sectional configuration of at least a portion of the barrel for the pump action firearm and (ii) a cross-sectional configuration of at least a portion of the receiver for the pump action firearm.

16. A system as recited in claim 14.

17. A system as recited in claim 14.

18. A system as recited in claim 14.

19. A system as recited in claim 18.

* * * * *